United States Patent [19]

Mima

[11] 4,416,110

[45] Nov. 22, 1983

[54] SPLICING APPARATUS FOR SPUN YARNS

[75] Inventor: Hiroshi Mima, Joyo, Japan

[73] Assignee: Murata Kikai Kabushiki Kaisha, Kyoto, Japan

[21] Appl. No.: 360,697

[22] Filed: Mar. 22, 1982

[30] Foreign Application Priority Data

Mar. 23, 1981 [JP] Japan ..... 56-42927

[51] Int. Cl.[3] ..... D01H 15/00

[52] U.S. Cl. ..... 57/22; 57/261

[58] Field of Search ..... 57/22, 23, 261

[56] References Cited

U.S. PATENT DOCUMENTS 3,903,680 9/1975 Isern ..... 57/22

4,263,775 4/1981 Mima ..... 57/22

4,322,943 4/1982 Rohner et al. ..... 57/22 X

*Primary Examiner*—Donald Watkins

*Attorney, Agent, or Firm*—Spensley, Horn, Jubas & Lubitz

[57] ABSTRACT

A splicing apparatus for spun yarns includes a splicing member having a splicing hole and a jet nozzle jetting a compressed fluid. Yarn end control nozzles, yarn cutting devices, a yarn gathering lever and yarn clamping devices are arranged in sequence on both sides of the splicing member. The yarn gathering lever for taking out the yarn ends left in the untwisting nozzle is regulated with the quantity of turning by a stopping means.

7 Claims, 15 Drawing Figures

SPLICING APPARATUS FOR SPUN YARNS

BACKGROUND OF THE INVENTION

There is known a fluid type splicing apparatus in which two yarn ends are inserted in the lapped state into a cylindrical splicing hole and a compressed fluid is jetted onto the lapped portion of the yarn ends to entangle the two yarn ends with each other to form one integrated yarn.

We previously proposed a splicing method in which in performing the splicing operation in the above-mentioned splicing apparatus, in order to promote entanglement of the lapped portion of two yarn ends and obtain a beautiful knot having a certain length, the yarns of the lapped portion are untwisted to produce a condition suitable for splicing. More specifically, according to this method, each yarn end is clamped at a point apart by a certain length from the top of the yarn end, both the yarn ends are sucked in suction nozzles arranged on both the sides of the splicing hole, the yarn ends are untwisted by air streams turning in the nozzles in a direction untwisting the yarn ends to disentangle and separate fibers of the top portions of the yarn ends, and the yarns in the suction nozzles are taken out by a yarn gathering lever capable of turning along a certain length and are inserted into the splicing hole.

In this method, parts of fibers disentangled in the suction nozzle are separated from the fiber bundle and are sucked into the nozzles, and therefore, the length of the disentangled yarn end left in the nozzle differs according to the fiber length of the yarn. More specifically, in case of a yarn having a long fiber length, the length of the yarn end left in the nozzle is increased, and in case of a yarn having a short fiber length, most of fibers are separated and the length of the yarn end left in the nozzle is decreased. Accordingly, when the yarn ends are taken out from the nozzle in the same quantities though the length of the untwisted and disentangled portion is different in the yarn ends, the length of the lapped portion differs among the respective yarn ends. If the length of the lapped portion is too long, the action of the swirling stream in the splicing hole is not exerted on the top portion of the yarn end, resulting in formation of horny projections on both the ends of the resulting joint. These horny projections are caught and broken by a knitting needle at the knitting step and the quality of the resulting knitted fabric is degraded. If the length of the lapped portion is too short, entanglement is caused only in the top portion of the yarn end where the strength of the joint in decreased.

SUMMARY OF THE INVENTION

The present invention relates to a splicing apparatus for spun yarns, in which a compressed fluid is jetted onto the lapped portion of two yarn ends to effect splicing.

A primary object of the present invention is to provide a splicing apparatus in which the foregoing defects are eliminated, and a strong joint can be formed without formation of horny projections in case of splicing of yarn ends different in the yarn kind, especially the fiber length.

Another object of the present invention is to provide a splicing apparatus in which the length of the joint can be adjusted in case of splicing of yarn ends of the same yarn kind.

The splicing apparatus of the present invention is characterized in that the quantity of turning of a yarn gathering lever for taking out yarn ends from untwisting suction nozzle arranged on both the sides of a splicing hole can freely be adjusted.

According to the present invention, the position of the second stopper for determining the turning position of the gathering lever for drawing yarn ends untwisted by the untwisting nozzles into the splicing hole can freely be adjusted. By dint of this characteristic feature, according to the present invention, the quantity of turning of the yarn gathering lever can be appropriately adjusted, and especially in case of yarns differing in the fiber length, the lapped portion of the yarn ends to be spliced can be adjusted and therefore, splicing of various kinds of yarns can be performed in one splicing apparatus. Furthermore, the joint length can be adjusted appropriately, and formation of undesirable horny projections can be prevented and a joint having strength and appearance suitable for the subsequent step can be obtained.

DETAILED DESCRIPTION OF THE INVENTION

The present invention will now be described in detail with reference to embodiments illustrated in the accompanying drawings.

Figure 1:
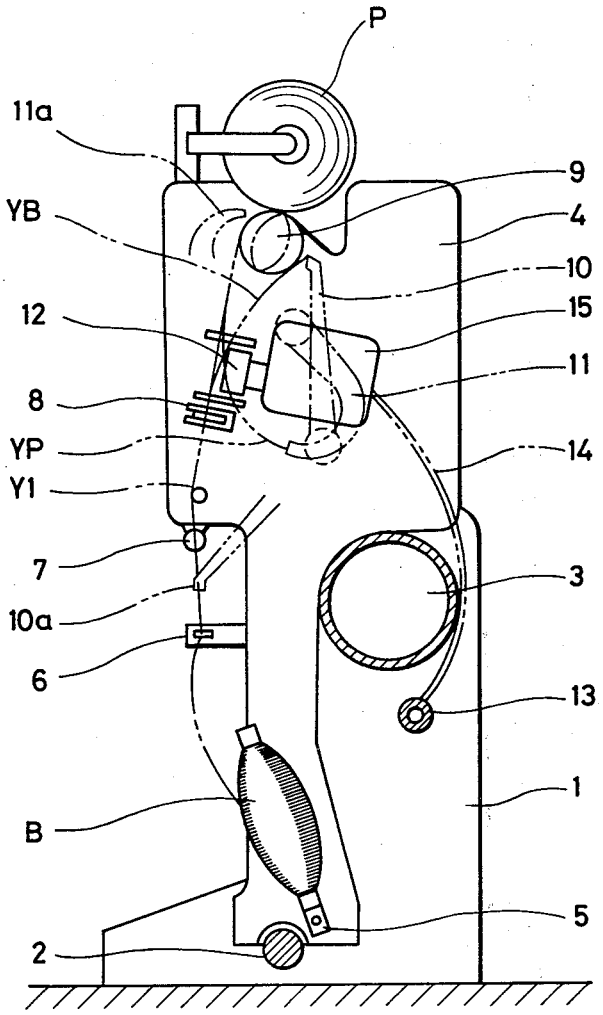
FIG. 1 is a side view diagrammatically illustrating the structure of an automatic winder to which the apparatus of the present invention is applied.

Referring to FIG. 1 diagrammatically illustrating an automatic winder to which the apparatus of the present invention is applied, a shaft or pipe 2 and a suction pipe 3 are laid out between every two adjacent side frames 1 and a winding unit 4 is turnably supported by the shaft 2 and while the automatic winder is being operated, the winding unit 4 is placed also on the suction pipe 3 and appropriately secured in this state. The pipe 3 is connected to a blower not shown in the drawings and a suction stream always acts on the pipe 3.

In this winding unit, rewinding of a yarn from a bobbin B to a package P is accomplished in the following manner. A yarn Y1 is taken out from the bobbin B on a peg 5 through a guide 6 and an appropriate tension is applied to the yarn by a tenser 7. The yarn is then passed through a detecting device 8 for performing detection of yarn unevenness such as slab, cutting of the yarn and detection of running of the yarn and is then wound on the package P rotated by a winding drum 9.

When yarn unevenness is detected by the detecting device 8, a cutter arranged in the vicinity of the detecting device is actuated to cut the yarn Y1 and stop the winding operation. Simultaneously, a first yarn guide suction arm 10 is actuated to guide a yarn YB on the side of the bobbin B to a splicing apparatus 12 located at a position apart from a normal yarn travel passage Y1 and a second Yarn guide suction arm 11 is actuated to guide a yarn YP on the side of the package P to the splicing apparatus 12. When splicing is completed in the splicing apparatus 12, the rewinding operation is started again. The first and second yarn guide suction arms 10 and 11 are connected to the pipe 3 performing the sucking action by the air stream. Since a fluid such as compressed air is used for the splicing apparatus 12, a conduit 14 is connected between another pipe 13 and a splicing box 15 to supply a compressed fluid to the splicing apparatus 12 from the pipe 13.

Figure 2:
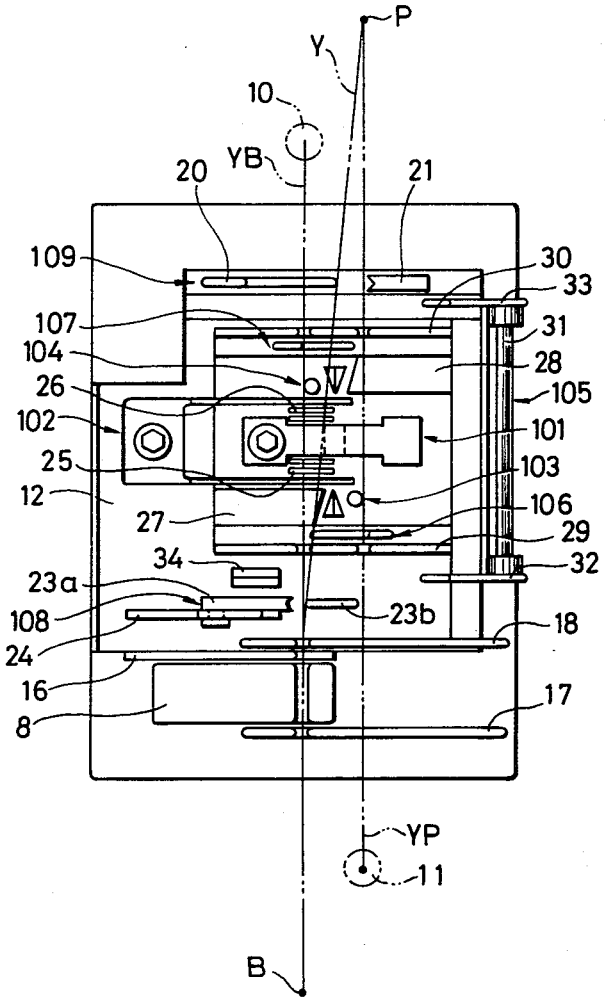
FIGS. 2 and 3 are front and plan views showing the entire structure of the splicing apparatus of the present invention.
Figure 3:
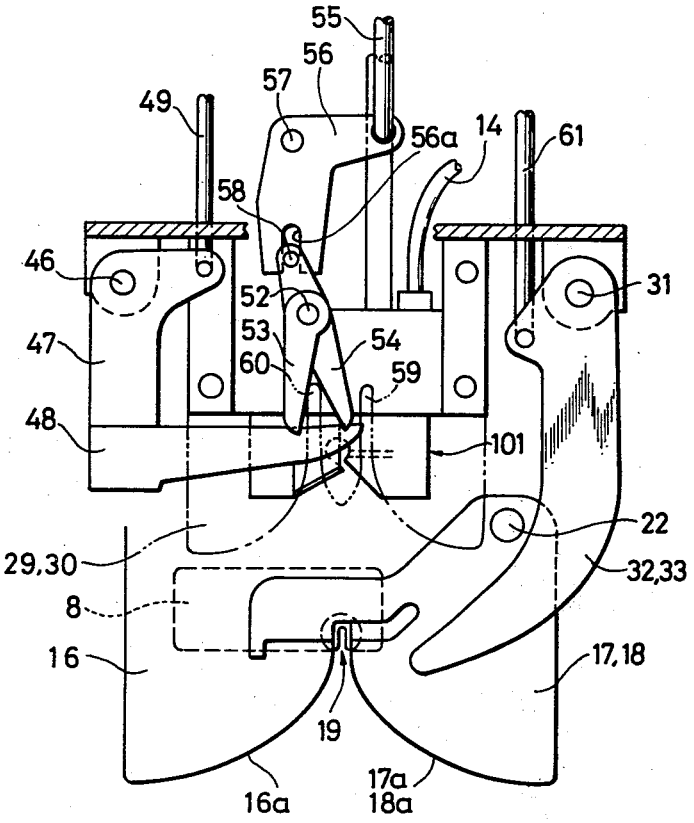

The entire structure of the splicing apparatus 12 is illustrated in detail in FIGS. 2 and 3. During the normal rewinding operation, the yarn Y is taken out from the bobbin B, is passed through the detecting device 8, a stationary guide 16 arranged on one end of the detecting device 8 and turnable guides 17 and 18 arranged on both the sides of the detecting device 8, travelled above the splicing apparatus 12 and wound on the package P.

The splicing apparatus 12 comprises as basic members a splicing member 101, a yarn pressing device 102, untwisting nozzles 103 and 104, a yarn gathering lever 105, yarn cutting devices 106 and 107 and yarn clamping devices 108 and 109. The above-mentioned first and second suction arms 10 and 11 are turned and moved above the splicing apparatus 12 so that the suction openings on the top ends of the suction arms 10 and 11 intersect each other, and the first and second suction arms 10 and 11 suck the yarn ends YB and YP on the sides of the bobbin B and package P, move to the outside of the splicing apparatus 12 and stop there.

Figure 4:
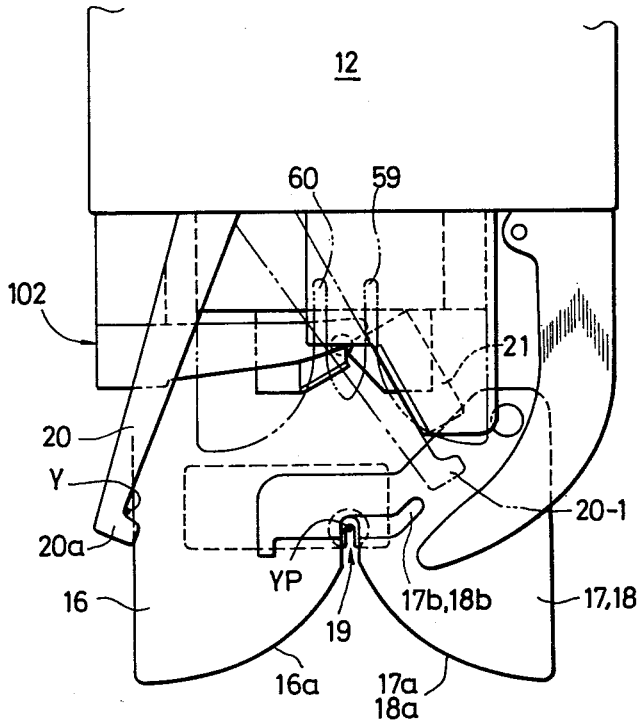
FIG. 4 is a plan view showing the operation of a turning lever for a clamp.

The first and second suction arms 10 and 11 are not simultaneously operated but they are operated with a certain time lag. More specifically, the yarn end YP on the side of the package P is turned to the outside of the splicing apparatus 12 by the suction arm 11 and substantially simultaneously with stoppage of the suction arm 11, a turning lever 20 of the clamping device 109 on the side of the package P is turned in the counterclockwise direction to a chain line position 20-1 as shown in FIG. 4 by a control cam not shown in the drawings and is brought into abutting contact with a supporting block 21 secured at a predetermined position, whereby the turning lever 20 is stopped. At this time, the yarn Y is moved in the state where the yarn Y is caught on a hook 20*a* of the turning lever 20 and the yarn Y is gripped between the supporting block 21 and the turning lever 20.

While the turning lever 20 is being operated, the yarn Y located on the stationary guide 16 and turning guides 17 and 18 is inserted in a guide groove 19 along inclined faces 16*a*, 17*a* and 18*a* of the guides 16, 17 and 18, and check of the absence or presence of the yarn Y or detection of erroneous suction of two or more of yarns by the suction arm 11 is performed by the detecting device 8 arranged at the same position as that of the guide groove 19. After confirmation of the presence of the yarn Y, the turning guide 17 and 18 are turned in the counterclockwise direction as shown in FIG. 4 by a control cam not shown in the drawings. The yarn end YP is separated from the detecting device 8 and inserted into escape grooves 17*b* and 18*b* of the turning guides 17 and 18.

Substantially simultaneously with the turning movement of the turning guides 17 and 18, the yarn end YB on the side of the bobbin B is sucked by the suction arm 10, and the suction arm 10 is turned in the direction opposite to the turning direction of the suction arm 11 and is moved to the outside of the splicing apparatus 12 and stopped there. Substantially simultaneously with stopping of turning of the suction arm 10, a supporting plate 23*a* of the yarn clamping device 108 is turned along a guide plate 24 in the same direction as the turning direction of the turning lever 20 by a control cam not shown in the drawings in the state where the yarn is hung thereon, and the supporting plate 23*a* is stopped on abutting contact with a supporting block 23*b* secured at a predetermined position, whereby the yarn YB is gripped between the supporting plate 23*a* and the supporting block 23*b*.

The splicing member 101 is arranged substantially at the center of the splicing apparatus 12, and on both the sides of the splicing member 101, there are arranged yarn guide pins 25 and 26, pressing device 102, control nozzles 103 and 104 and yarn guides 27 and 28. Furthermore, there are arranged yarn cutting devices 106 and 107 and fork guides 29 and 30 in sequence. A yarn gathering lever 105 comprising a supporting shaft 31 and levers 32 and 33 turning with the shaft 31 being as the fulcrum is arranged in the side portion of the splicing member 101. After the detecting device 8 detects slub or other unevenness of the yarn Y to actuate a cutter not shown in the drawings to perform the cutting operation and the suction arms 10 and 11 are operated to guide the yarn ends YP and YB to the outside of the splicing appa ratus 12, the yarn gathering lever 105 guides the yarn ends YP and YB toward the splicing apparatus 12. Incidentally, the turning range of the yarn gathering lever 105 is adjusted so that the yarn gathering lever 105 is stopped on abutting contact with a stopper 34 or stopper 70.

Figure 5:
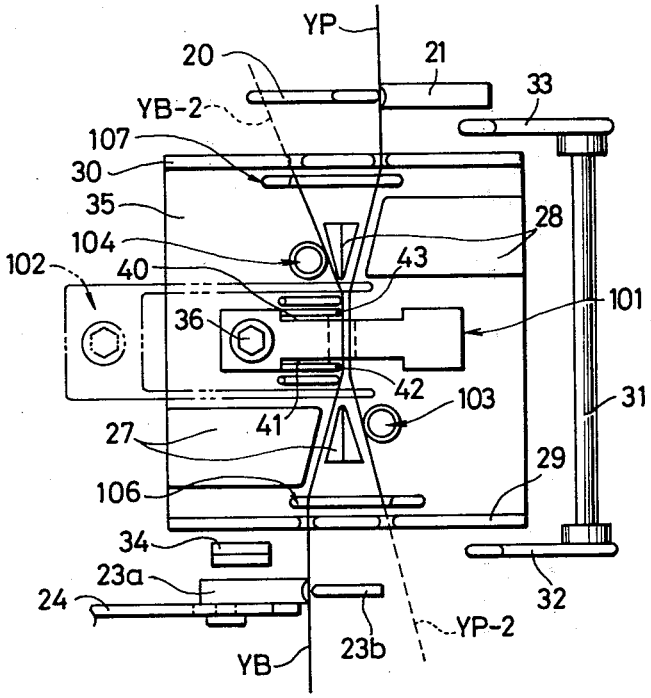
FIG. 5 is a front view showing the yarn passage in the state where yarn ends are inserted into a splicing hole.
Figure 6:
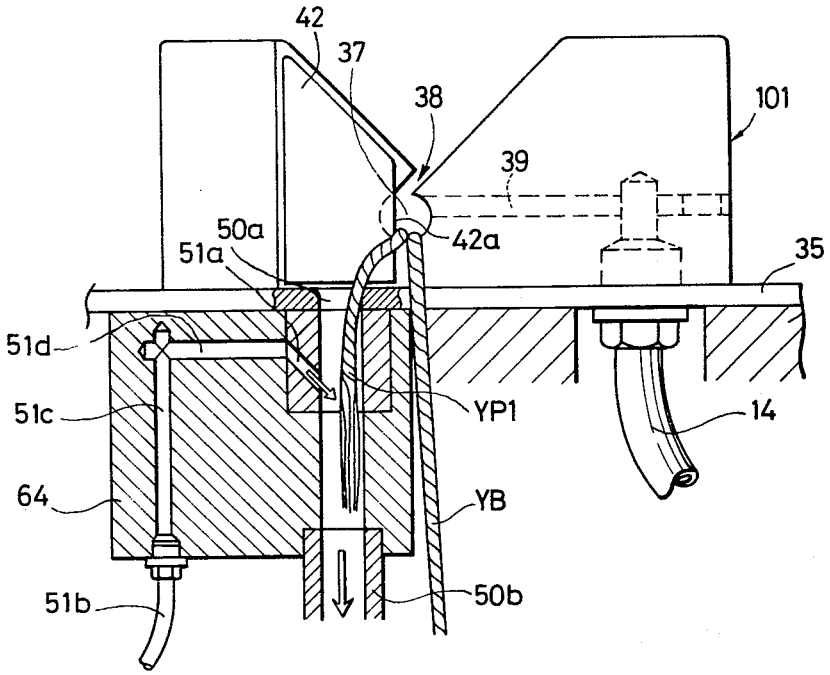
FIG. 6 is a partially sectional plan view showing a splicing hole and a yarn end untwisting nozzle.

Referring to FIGS. 5 and 6, the splicing member 101 arranged substantially at the center of the splicing apparatus 12 is secured to a bracket 35 through a screw 36, and a cylindrical splicing hole 37 is formed substantially at the center of the splicing member 101 and a slit 38 for insertion of the yarn Y from the outside is formed entirely along the tangential direction of the splicing hole 37. Furthermore, a jet nozzle hole 39 opened to the splicing hole 37 in the tangential direction is formed. In the present embodiment, the cylindrical nozzle hole 39 is formed substantially at the center of the splicing hole 37 in the longitudinal direction thereof. However, instead of the cylindrical nozzle hole 39, there may be formed a laterally expanded nozzle hole 39 having an ellipsoidal, rectangular or long-groove-like sectional shape or a plurality of nozzle holes 39. When the yarn to be spliced is thick, for example, when a yarn having a count number of 10 or more is spliced, especially good results can be obtained by using a nozzle hole having a laterally expanded section.

Control plates 42 and 43 are screwed to both the sides of the splicing member 101 through spacers 40 and 41. The control plates 42 and 43 are positioned so that specific side edges 42*a* and 43*a* of the control plates 42 and 43 traverse a part of the opening of the splicing hole, and these control plates 42 and 43 perform positioning of yarn ends together with a yarn pressing plate 48 described hereinafter and they are effective for preventing the yarn ends from flying out from the splicing hole 37 together with the air stream flowing out from the splicing hole 37.

Referring to FIGS. 2 and 3, the pressing device 102 arranged on both the sides of the splicing member 101 co-operates with turning of the yarn gathering lever 105 at the splicing step to take out the yarn ends YP1 and YB1 untwisted by the splicing untwisting nozzles 103 and 104 and set them within the splicing hole 37 and simultaneously, the pressing device 102 controls the positions of both the yarns YP and YB. In the pressing device 102, a pressing plate 48 is screwed to a turning lever 47 turnable with a supporting shaft 46 fixed at a constant position being as the fulcrum and if a rod 49 is operated by a control cam not shown in the drawings, the pressing plate 48 is turned.

Figure 7:
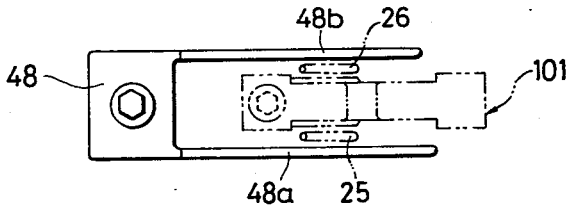
FIGS. 7 and 8 are front and plan views showing a yarn pressing lever.
Figure 8:
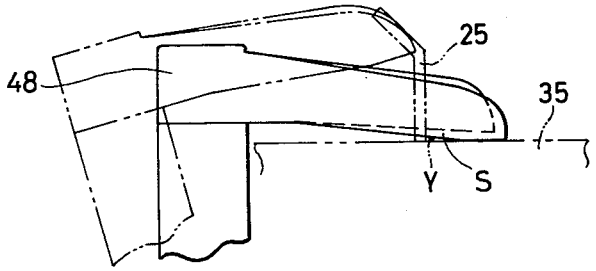

The yarn pressing plate 48 is illustrated in detail in FIGS. 7 and 8. The pressing plate 48 has forked pieces 48*a* and 48*b* extended to the top end, and these forked pieces are different to some extent in the shape. When the pressing plate 48 is turned and one forked piece 48*a* falls in abutting contact with the face of the bracket 35 to press the yarn Y among the top face of the bracket 35, the yarn guide pin 25 and the forked piece 48*a*, a certain space S allowing passage of the yarn Y is formed among the other forked piece 48*b*, the top face of the bracket 35 and the yarn guide pin 26, whereby the position control is effected only in the direction traversing the yarn Y at a right angle.

The yarn pressing action of the forked piece 48*a* of the pressing plate 48 is performed to prevent return of twists caused by the action of a balloon formed on the yarn ends YB1 and YP1 by the action of the compressed fluid as described hereinbefore.

Accordingly, the degree of this pressing action is controlled to such an extent that twists on the yarn Y are not released by the action of the balloon. If this pressing action is too strong, fluffs are formed and no good results can be obtained. Since the other yarn Y is rotated in the twisting direction by the action of the balloon, this yarn need not particularly be held and it is sufficient if this yarn Y is pressed only to such a degree that the position thereof is controlled.

As shown in FIG. 6, a nozzle hole 50*a* for untwisting the yarn end YB1 or YP1 is formed on each of untwisting nozzles 103 and 104 arranged on both the sides of the yarn pressing device 102. The yarn end YB1 on the side of the bobbin B and the yarn end YP1 on the side of the package P, to be spliced, are guided into the nozzle holes 50*a* through the splicing hole 37. Guiding of the yarn ends YB1 and YP1 into the nozzle holes 50*a* is accomplished by the sucking action of the above-mentioned suction pipe 3 through flexible pipes 50*b*. When the yarn end YP1 is guided into the nozzle hole 50*a*, the yarn end YP1 is untwisted by a fluid jetted from a jet nozzle 51*a* opened inclinedly to the nozzle hole 50*a*, and the respective fibers are separated and arranged substantially in parallel to one another.

More specifically, the end-free yarn Y inserted in the nozzle hole 50*a* is untwisted on the end portions thereof by a compressed fluid jetted from the jet nozzle 51*a*. There are two kinds of twists, "Z twists" and "S twists", which are given to the yarn Y. The twisting directions of these two kinds of twists are opposite to each other. Accordingly, the jetting direction of the jet nozzle 51*a* should be determined appropriately according to the twisting direction of the yarn Y.

Referring to FIGS. 2 and 3, the cutting devices 106 and 107 have a scissor-like shape, and in each cutting device, a movable blade 54 is turned with a stationary pin 52 being as the fulcrum so that the movable blade 54 intersects a stationary blade 53, whereby the yarn Y is cut. When a rod 55 is actuated by a control cam not shown in the drawings, a bifurcate lever 56 is turned in the clockwise or counterclockwise direction with a shaft 57 being as the fulcrum, and the fork-like portion 56*a* of the lever 56 moves a supporting pin 58 on the other end of the movable blade 54, whereby the movable blade 54 is operated.

Fork guides 29 and 30 are arranged outwardly of the yarn cutting devices 106 and 107, and guide grooves 59 and 60 are formed on the fork guides 29 and 30, respectively.

The yarn gathering lever 105 arranged in the side portion of the splicing apparatus 12 is turned in the clockwise direction with a shaft 31 being as the fulcrum to introduce the yarns YP and YB into guide grooves 59 and 60 when a rod 61 is operated by a control cam not shown in the drawings.

Figure 9:
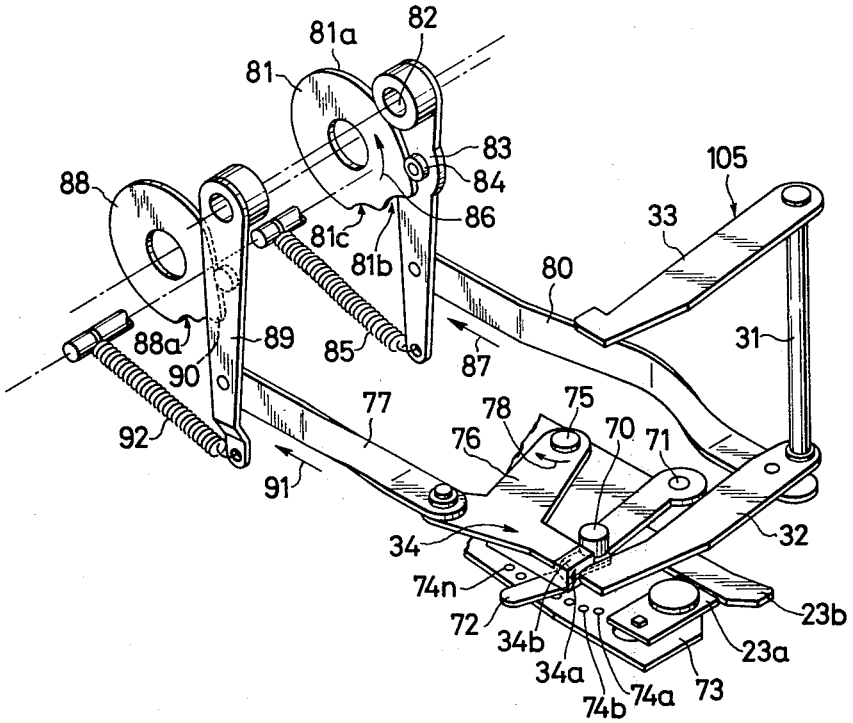
FIG. 9 is a perspective view illustrating first and second stoppers of a yarn gathering lever.

As shown in FIG. 9, the yarn gathering lever 105 abuts against a yarn cutting first stopper 34 or a second stopper 70 for adjusting the lap length of the yarn ends, whereby the turning position of the yarn gathering lever 105 is regulated.

More specifically, the first stopper 34 comprises a block 34*b* secured to the top end of a lever 76 turnable between two positions with a stationary shaft 75 being as the center, and the first stopper 34 is moved between an operation position indicated by a solid line in FIG. 9 and a non-operation position turned in the direction of an arrow 78 with the shaft 75 being as the center by means of a rod connected to control cams not shown in the drawings and the stopper 34 is secured at one of the above two positions. When the package side yarn end YP and the bobbin side yarn end YB are clamped by the clamping devices shown in FIGS. 2 and 3 and they are cut by the cutting devices 106 and 107, the lever 32 of the yarn gathering lever 105 is located at the position where the lever 32 falls in abutting contact with the end face 34*a* of the first stopper 34, whereby the length of the yarn end between the clamping point and the top of the yarn end is kept constant.

Figure 15:
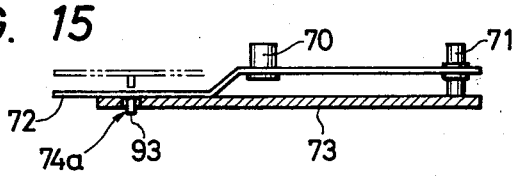
FIG. 15 is a partially sectional view showing an adjusting lever.

The second stopper 70 is secured on an adjusting lever 72 turnable with a stationary shaft 71 being as the center, and as shown in FIG. 15, a pin 93 is secured to the lower face of the adjusting lever 72. By engagement of this pin 93 with optional one of positioning holes 74*a* through 74*n* formed on an arc having the center on the shaft 71 on a stationary plate 73, the position of the adjusting lever 72, that is, the position of the stopper 70, is selected and determined. The movement of the lever 72 is accomplished by bring up the lever 72 to a position indicated by a two-dot chain line in FIG. 15.

In the above-mentioned embodiment, positioning of the adjusting lever is accomplished by utilizing the above-mentioned holes 74*a* through 74*n*. There may be adopted a modification in which teeth resembling saw-teeth are formed on an arc with the shaft 71 being as the center and a pin fixed to the adjusting lever is engaged with optional one of these teeth to effect positioning of the adjusting lever, or another modification in which an arc-like long groove is formed on a stationary board, a rod is screwed to the adjusting lever and the rod is moved through the long groove and secured at an appropriate position by a bolt, whereby stepless positioning can be accomplished.

The lever 32 of the yarn gathering lever 105 is arranged turnably with the shaft 31 being as the center, and the lever 32 is connected to a lever 83 which is turned with a shaft 82 being as the fulcrum by a control cam 81 through a rod 80. A spring 85 is connected to the lever 83 so that a cam follower 84 is urged to a cam face 81*a*, whereby the yarn gathering lever 32 is urged toward the stopper 34 or 70 through the rod 80. The lever 83 is moved in follow-up with the shape of the cam face 81*a*, and in order to turn the lever 32 at an optional position of the second stopper 70, the depth of one 81*c* of concave portions 81*b* and 81*c* of the cam face is adjusted so that the lever 32 can be turned to the stopper 70 at the position of the hole 74*n*. It is sufficient if the depth of the concave portion 81*b* is such that the lever 32 can fall into abutting contact with the stopper 34 at the normal position.

Accordingly, if the cam 81 is rotated in the direction of an arrow 86, the rod 80 is drawn in the direction of an arrow 87 by the concave portion 81*b* and the lever 32 is turned to the stopper 34, and subsequently, the lever 34 is once moved in the reverse direction. At this time, the lever 32 is once turned in the direction separating from the stopper 34, and simultaneously, the cam follower 90 of the lever 89 is engaged with the concave portion 88*a* of the cam 88 and the rod 77 is drawn in the direction of an arrow 91. Accordingly, the lever 76 is turned in the direction of an arrow 78 with the shaft 75 being as the center and the first stopper 34 is turned to the non-operation position. Then, the cam follower 84 is engaged with the concave portion 81, and the yarn gathering lever 32 is turned to the position of the second stopper 70.

Accordingly, the yarn gathering lever 105 is once turned from the position having abutting contact with the stopper 34 in the direction separating from the first stopper 34, and both the cut yarn ends are sucked in the untwisting nozzles 103 and 104 and they are thus untwisted. In the state where the sucking operation of the nozzles 103 and 104 is stopped, the yarn gathering lever 105 is turned again in the direction approaching to the first stopper 34, and when the yarn ends in the untwisting nozzles are taken out, the first stopper 34 is turned to the non-operation position not shown in the drawings. Accordingly, the lever 32 is stopped at the position falling in contact with the second stopper 70, and the quantity of the yarn ends taken out from the untwisting nozzles 103 and 104, that is, the length of the lap portion of both the yarn ends YB and YP, is determined. If the adjusting lever 74 is located on the side of the hole 74*n*, the quantity of turning of the yarn gathering lever 105 is increased and the quantity of the yarn ends taken out from the nozzles 103 and 104 is increased. If the adjusting lever 72 is located on the side of the hole 74*a*, the quantity of the yarn gathering lever 105 is decreased and the quantity of the yarn ends from the untwisting nozzles is reduced.

The operation of the splicing apparatus having the above-mentioned structure will now be described.

Figure 10:
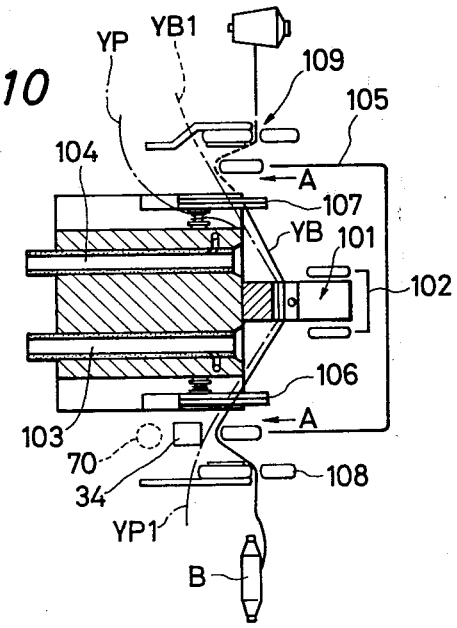
FIGS. 10 through 12 are diagrams illustrating the splicing operation.

Referring to FIG. 10, the yarn YB on the side of the bobbin B and the yarn YP on the side of the package P are gripped by the clamping devices 108 and 109, respectively, and the yarn gathering lever 105 is moved in the direction of an arrow A and falls in abutting contact with the first stopper 34. In this state, the cutting devices 106 and 107 are operated to cut both the yarn ends along a certain length from the clamping point. Therefore, the length between the clamping point and the top of the cut yarn end is kept constant irrespectively of the yarn kind. Namely, this length is a constant length mechanically determined.

Figure 11:
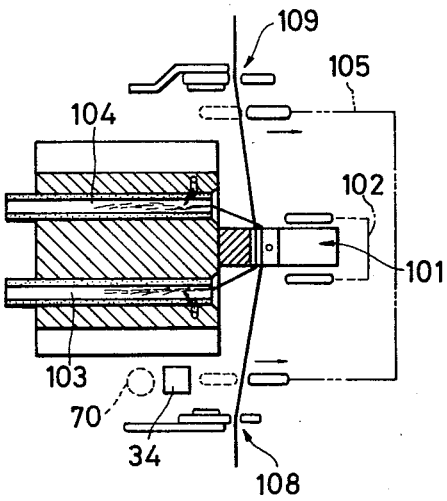

Then, the cut yarn ends YB1 and YP1 are sucked in the nozzles 103 and 104 by the sucking action of the untwisting nozzles 103 and 104, and as shown in FIG. 11, the yarn gathering lever 105 is moved in the direction separating from the yarn, and the yarn ends are further sucked in the untwisting nozzles and the top portions of the yarn ends are sufficiently untwisted and disentangled.

As described hereinbefore, the length of the untwisted and disentangled yarn ends left in the untwisting nozzles differs according to the fiber length. For example, cotton yarns include a yarn composed of short fibers having an average length of about 20 mm and a yarn composed of a long length having an average length of about 50 mm. In case of a yarn having a short fiber length, untwisted fibers are readily separated and the length of the yarn end left in the nozzle is short. In contrast, in case of a yarn having a long fiber length, the length of the yarn end left in the nozzle is long. Thus, the length of the untwisted yarn end left in the nozzle differs according to the fiber length.

Figure 12:
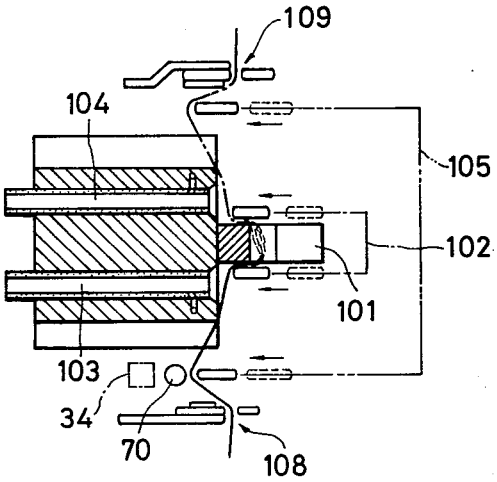

The yarn ends YB1 and YP1 are untwisted and disentangled by the untwisting nozzles 103 and 104, and a state suitable for splicing is produced and the sucking action of the untwisting nozzles 103 and 104 is stopped. Simultaneously with or subsequently to stopping of the operation of the untwisting nozzles 103 and 104, as shown in FIG. 12, the yarn gathering lever 105 is operated again, and the lever 9 shown in FIG. 9 is turned to the position falling in contact with the second stopper 70 while guiding both the yarn ends YB1 and YP1 and the yarn pressing lever 102 is operated and turned to the position falling in contact with the face of the bracket 35 shown in FIG. 8. Thus, the pressing lever 102 performs the yarn-pressing action, and the lever 102, together with the control plate, performs the operation of positioning the yarn ends so that both the yarn ends are contacted with each other in the splicing hole.

Figure 13:
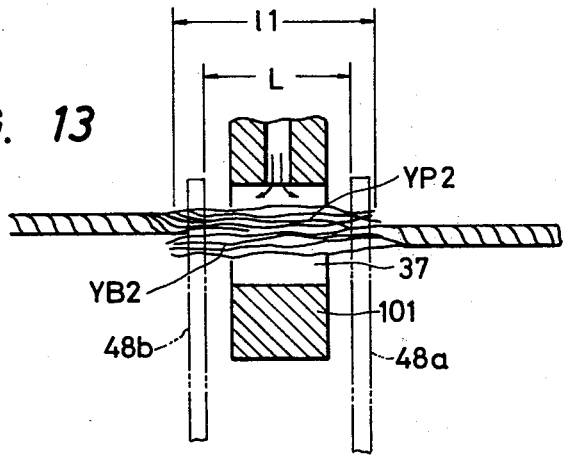
FIGS. 13 and 14 are diagrams showing the lapped portion of yarn ends differing in the fiber length.
Figure 14:
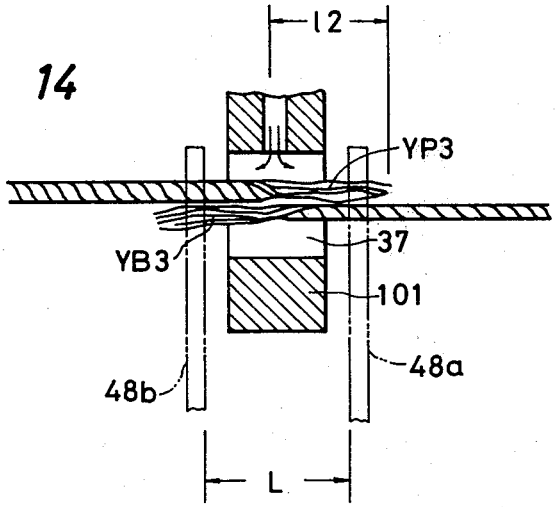

By the actions of the yarn gathering lever 105 and the yarn pressing device 102, the yarn ends YB1 and YP1 left in the untwisting nozzles 103 and 104 are drawn into the splicing hole 37 and both the yarn ends to be spliced are set in the lapped state. At this step, the quantity of turning of the yarn gathering lever 105 is changed according to the position of the second stopper 70 shown in FIGS. 9 and 12, and the length of the lapped portion of the yarn ends is kept substantially constant irrespectively of the kind of the yarn as shown in FIGS. 13 and 14.

For example, when yarn ends YP2 and YB2 composed of long fibers are lapped together, the untwisted yarn ends have a long length l1 corresponding substantially to the length between the yarn pressing lever 48*a* and 48*b*. In this case, it is necessary that the second stopper 70 should be positioned on the side of the hole 74*n* to increase the quantity of turning of the yarn gathering lever 105. In case of yarn ends composed of short fibers, since the yarn ends left in the untwisting nozzles are short, if the yarn gathering lever 105 is turned in the same manner as in FIG. 13, the length of the lapped portion is short and both the yarn ends are not pressed by the yarn pressing levers 48*a* and 48*b* but separated from each other, with the result that splicing becomes impossible. Accordingly, in this case, the second stopper 70 is positioned on the side of the hole 74*a* in FIG. 9, and the quantity of turning of the yarn gathering lever 105 is reduced. More specifically, as shown in FIG. 14, the length 12 of the lapped portion of the yarn ends YP3 and YB3 is shorter than the length l1 of the lapped portion shown in FIG. 13, but in each case, the length L of the joint is substantially equal.

In the state where both the yarn ends are lapped together, a compressed fluid is jetted in the splicing hole 37, whereby the untwisted fibers are entangled and twisted with one another to effect splicing.

In case of yarns of the same kind, especially yarns having a substantially equal average fiber length, by moving the adjusting lever 72 shown in FIG. 9, the length of the joint can be changed and adjusted. More specifically, in the case where both the yarn ends left in the untwisting nozzles 103 and 104 have substantially the same length, by increasing the quantity of turning of the yarn gathering lever 105, that is, by positioning the second stopper 70 on the side of the hole 74*n*, the length of the lapped portion of the yarn ends is shortened and the length of the joint is accordingly shortened. In contrast, if the second stopper 70 is positioned on the side of the hole 74*a*, the quantity of turning of the yarn gathering lever 105 is reduced, and the length of the lapped portion is increased and the length of the joint is accordingly increased.

In case of yarns of the same kind, a joint having a high strength and a joint having a beautiful appearance can optionally be obtained by adjusting the length of the joint in the above-mentioned manner.

What is claimed is:

1. A splicing apparatus for spun yarns comprising a splicing member arranged at the center of the splicing apparatus and including a splicing hole for jetting a compressed fluid to the lapped portion of two yarn ends to effect splicing, clamping device for clamping yarn ends on the package side and on the bobbin side, respectively, before the yarn splicing operation, cutting device for cutting yarn ends, untwisting nozzles which are arranged on both the sides of the splicing hole so that the yarn ends of a predetermined length from the clamping point are sucked into the untwisting nozzles to be untwisted, a yarn gathering lever having a supporting shaft and levers turning with the shaft as the fulcrum and arranged between the clamping point and the splicing hole to take out the yarn ends left in the untwisting nozzles, and a stopping means for regulating the quantity of turning of the yarn gathering lever.

2. A splicing apparatus as claimed in claim 1, wherein said stopping means comprises a first stopping member for keeping the length of the yarn end constant between the clamping point and the top end of the yarn on cutting the yarn ends by the cutting devices and a second stopping member for adjusting the lap length of the yarn ends which are arranged in the splicing hole.

3. A splicing apparatus as claimed in claim 2, wherein said first stopping member comprises a lever tunable between two positions, an operation position and non-operation position, with a stationary shaft being as the center and block secured to the top end of the lever, and the lever of the yarn gathering lever falls in abutting contact with the end face of the block of the stopper so that the yarn end can be cut in constant length between the clamping paint and the top of the yarn end, when the yarns are clamped by the clamping devices.

4. A splicing apparatus as claimed in claim 2, wherein said second stopping member comprises an adjusting lever turnable with a stationary shaft, a stopper secured on the adjusting lever, a pin secured to the lower face of the adjusting lever and a stationary plate disposed under the adjusting lever and provided with positioning means being capable engaged with the pin at desirable position, and the lever of the yarn gathering lever is stopped at the position falling in contact with the stopper to determine the length of the lapped portion of both the yarn ends when the yarn ends are taken out from the untwisting tube by the yarn gathering lever.

5. A splicing apparatus as claimed in claim 4, wherein said positioning means of the adjusting lever are positioning holes formed on an arc having the center on the stationary shaft on the stationary plate so that the pin of the adjusting lever can engage with optional one of the positioning holes.

6. A splicing apparatus as claimed in claim 4, wherein said positioning means are teeth resembling sowteeth formed on an arc with the stationary shaft being as the center so that the pin fixed to the adjusting lever can be engaged with optional one of these teeth.

7. A splicing apparatus as claimed in claim 4, wherein said positioning means is an arc-like long groove formed on the stationary plate and a rod is screwed to the adjusting lever instead of the pin so that the rod is moved through the long groove and secured at an appropriate position by a bolt.

* * * * *